US005724926A

United States Patent [19]

Wilke

[11] Patent Number: 5,724,926

[45] Date of Patent: Mar. 10, 1998

[54] ROTARY VALVE ASSEMBLY FOR AN INTERNAL COMBUSTION ENGINE

[75] Inventor: Robert O. Wilke, Westmont, Ill.

[73] Assignee: Eagle Heads, Ltd., Westmont, Ill.

[21] Appl. No.: 576,927

[22] Filed: Dec. 22, 1995

[51] Int. Cl.[6] ..... F01L 7/02

[52] U.S. Cl. ..... 123/80 BA; 123/190.2

[58] Field of Search ..... 123/337, 41.4, 123/190.1, 190.2, 190.12, 80 R, 80 C, 80 BA

[56] References Cited

U.S. PATENT DOCUMENTS

| | | | |
|---|---|---|---|
| 1,519,513 | 12/1924 | Smith | 123/41.4 |
| 3,993,036 | 11/1976 | Tischler | 123/190.2 |
| 4,163,438 | 8/1979 | Guenther et al. | 123/190.2 |
| 4,198,946 | 4/1980 | Rassey | 123/41.4 |
| 4,271,800 | 6/1981 | Borracci . | |
| 4,317,440 | 3/1982 | Thatcher et al. | 123/337 |
| 4,381,737 | 5/1983 | Turner | 123/41.4 |
| 4,421,077 | 12/1983 | Ruggeri | 123/190.8 |
| 4,606,309 | 8/1986 | Fayard . | |
| 4,751,900 | 6/1988 | Ruffolo . | |
| 4,944,261 | 7/1990 | Coates . | |
| 4,953,527 | 9/1990 | Coates . | |
| 4,976,232 | 12/1990 | Coates . | |
| 4,989,558 | 2/1991 | Coates . | |
| 4,989,576 | 2/1991 | Coates . | |
| 4,995,354 | 2/1991 | Morikawa . | |
| 5,105,784 | 4/1992 | Davis et al. . | |
| 5,109,814 | 5/1992 | Coates . | |
| 5,205,251 | 4/1993 | Conklin . | |
| 5,251,591 | 10/1993 | Corrin | 123/337 |
| 5,257,601 | 11/1993 | Coffin . | |
| 5,273,004 | 12/1993 | Duret et al. . | |
| 5,361,739 | 11/1994 | Coates . | |
| 5,392,743 | 2/1995 | Dokonal . | |
| 5,448,971 | 9/1995 | Blundell et al. | 123/190.12 |
| 5,454,357 | 10/1995 | Elder | 123/337 |
| 5,474,036 | 12/1995 | Hansen et al. | 123/80 C |

OTHER PUBLICATIONS

"The Rotary Valve Engine Gets Another Look", John Holusha, The New York Times, C4–C5, Aug. 12, 1992.

"At The Forefront of Technology", Coates Engines Brochure.

Provisional Order Form and Test Data, Coates International, Ltd., 1995.

"Important World News". Coates.

*Primary Examiner*—Erick R. Solis

*Attorney, Agent, or Firm*—Dressler, Rockey, Milnamow & Katz, Ltd.

[57] ABSTRACT

A mode changer for an internal combustion engine comprises a body member disposed within a housing. The body member may be adapted to communicate with an outer surface of a rotary valve. A resilient member may be disposed in the housing capable of biasing the body member against the outer surface of the rotary valve. An engageable member may selectively move the body member. A method of changing the timing of an engine is provided. The method comprises the step of rotating an intake rotary valve having a leading edge and trailing edge for registry with an intake passage, changing the point of registry of the leading edge with the intake passage, closing the intake passage at a fixed time, rotating an exhaust rotary valve having a leading edge and trailing edge for registry with an exhaust passage, changing the point of registry of the trailing edge with the exhaust passage, and opening the exhaust passage at a fixed time.

26 Claims, 6 Drawing Sheets

10
12
14
22
24
26
28
30
38
42
44
46
50
52
54
58
62
64
66
67
96
100
104

ROTARY VALVE ASSEMBLY FOR AN INTERNAL COMBUSTION ENGINE

FIELD OF THE INVENTION

The present invention generally relates to internal combustion engines, and more particularly, to a rotary valve assembly for an internal combustion engine.

BACKGROUND OF THE INVENTION internal combustion engines generally comprise at least one piston movable within a cylinder by a crank shaft. When an intake passage is opened, the piston moves downwardly to draw a fuel-air mixture into the cylinder for combustion. As the piston reaches the bottom of the cylinder, the intake passage will close and the piston will rise compressing the fuel/air mixture. After combustion, the exhaust gases escape from the cylinder through an exhaust passage.

Typically, engines are generally designed with the opening of the intake valve and the closing of the exhaust valve occurring at a fixed time. The timing and duration of the valves in these engines are usually designed based upon the particular application of the engine and may not be changed to increase engine horsepower.

Rotary valves may be used to manage the flow of the gases into and out of the cylinder of the engine. Rotary valves have been developed to adjust the timing and duration of the valves of an engine. For example, U.S. Pat. No. 3,993,036 shows a rotary valve having a spring loaded sleeve at the trailing edge of the rotary valve. Although the sleeve may retard the closing of the valve, the sleeve does not allow for adjustment of the opening of the valve. Further, the sleeve may only retard the closing of the valve at high revolutions per minute (r.p.m.) of the engine. The complexity of the valve may also increase the manufacturing and repair costs, and the timing and duration of the valve may not be controlled upon command during engine operation.

U.S. Pat. No. 4,163,438 shows rotary valves that may be axially displaced in a cylinder head to change the timing of the valves. However, the air flow through the valves may be restricted when the timing of the valves is changed. Further, as the r.p.m. of the engine increases, it may be desirable to provide greater air flow into the combustion chamber. It may also be difficult to keep the valves cool because the axial movement of the valves. As a result, the valves may overheat. Additionally, the complexity of the valve assembly may increase manufacturing and repair costs.

U.S. Pat. No. 4,421,077 shows flappers positioned near the leading and trailing edges of an intake rotary valve. The flappers may increase the length of the port of the intake rotary valve, allowing the timing of the valve to change. However, the opening of the flappers depends upon the pressure across the opening of the intake valve, and the flappers will usually only open at high r.p.m. Further, the timing of valves may not be controlled upon command during engine operation.

U.S. Pat. No. 5,205,251 discloses a rotary valve disposed within a rotatable sleeve. The sleeve has openings on opposing sides in order to change the timing of the valve. However, when changing the timing of the valves, the closing of the intake valve and the opening of the exhaust valve will usually be changed. Further, the air flow through the valve may be restricted when the timing of the valves is changed. The complexity of the valve assembly may also increase manufacturing costs and the costs of repair.

U.S. Pat. No. 5,392,743 discloses a single rotary valve positioned on a shaft that is axially displaced by a cam to varying an open duration of the valve. However, when changing the duration of the valve, the exhaust may contaminate the intake charge by diluting the intake mixture and thereby reducing engine efficiency. Further, the complexity of the valve assembly may increase manufacturing and repair costs.

Accordingly, there exists a need for an engine with improved valve timing control that can adjust the opening of the intake valve and closing of the exhaust valve. It is desirable to change the timing of the valves without restricting the air flow through the valves at higher r.p.m. It would also be beneficial to change the timing of the valves upon command.

SUMMARY OF THE INVENTION

The invention provides a rotary valve assembly for use with an internal combustion engine that may adjust the opening of the intake valve and/or the closing of the exhaust valve. The timing and duration of the valves may be adjusted upon command during operation. The rotary valve assembly preferably reduces repair costs and improves engine reliability and performance. The present invention also provides an improved cooling system for a rotary valve type engine. The cooling system cool the valves to decrease emissions and to extend the life of the engine.

In one aspect of the invention, a mode changer comprises a body member disposed within a housing. The body member may be adapted to communicate with an outer surface of a rotary valve. A resilient member may be disposed in the housing capable of biasing the body member against the outer surface of the rotary valve. An engageable member may selectively move the body member.

In another aspect of the invention, an engine apparatus comprises a rotary valve for opening and closing an intake passage and for opening and closing an exhaust passage. A mode changer is adjacent to the rotary valve and may be adapted to engage an outer surface of the rotary valve.

According to another aspect of the invention, an engine apparatus comprises an intake rotary valve for opening and closing an intake passage and an exhaust rotary valve for opening and closing an exhaust passage. An intake mode changer is adjacent to the intake rotary valve and may be adapted to change the cross-sectional area of the intake passage.

In yet another aspect of the invention, an engine apparatus comprises a cylinder head having a cavity. The cavity has a first opening in communication with an intake passage, and a second opening in communication with an exhaust passage. A first mode changer changes the cross-sectional area of the first opening.

In another aspect of the invention, an engine apparatus comprises a cylinder head having a first cavity and a second cavity. The first cavity has a first opening in communication with an intake passage. The second cavity has a second opening in communication with an exhaust passage. A first mode changer is adapted to change the cross-sectional area the first opening.

According to another aspect of the invention, an engine apparatus comprises a rotary valve for opening and closing an intake passage and an exhaust passage. The rotary valve has a leading and trailing edge. Means are provided for changing the point where the leading edges of the rotary valve communicates with the intake passage and for changing the point when the rotary valve rotates out of communication with the exhaust passage.

In another aspect of the invention, a method of changing the timing of an engine is provided. The method comprises the step of rotating an intake rotary valve having a leading edge and trailing edge for registry with an intake passage, changing the point of registry of the leading edge with the intake passage, closing the intake passage at a fixed time, rotating an exhaust rotary valve having a leading edge and trailing edge for registry with an exhaust passage, changing the point of registry of the trailing edge with the exhaust passage, and opening the exhaust passage at a fixed time.

In another aspect of the invention, a rotary valve comprises a body member having a cavity capable of holding a fluid. A fluid inlet and outlet are in communication with the cavity.

In another aspect of the invention, an internal combustion engine comprises a cylinder having a combustion chamber. A rotary valve opens and closes an intake passage and an exhaust passage. The exhaust passage is in communication with the combustion chamber, and the intake passage is in communication with the combustion chamber. A mode changer is adjacent to the rotary valve and may be adapted to engage the outer surface of the rotary valve.

It is to be understood that both the foregoing general description and the following detailed description are exemplary and explanatory and are intended to provide further explanation of the invention as claimed.

The invention, together with further objects and attendant advantages, will best be understood by reference to the following detailed description of the presently preferred embodiment of the invention, taken in conjunction with the accompanying drawings.

DETAILED DESCRIPTION OF THE DRAWINGS AND THE PREFERRED EMBODIMENTS OF THE INVENTION

Figure 1:
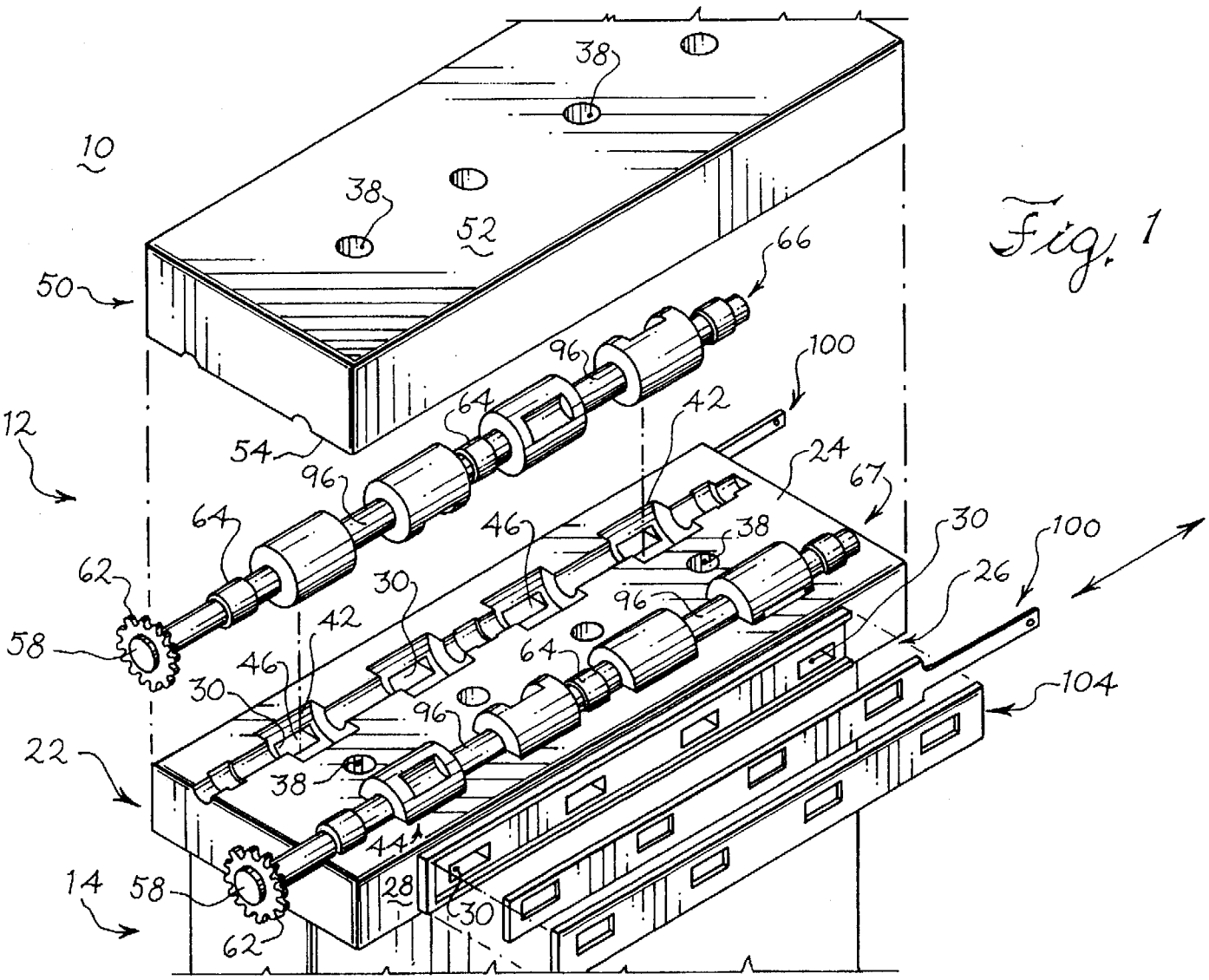
FIG. 1 shows a partial exploded perspective view of a preferred embodiment of a cylinder head made in accordance with the present invention.

Referring now to the drawings in detail, and particularly to FIG. 1, a preferred embodiment of a portion of an internal combustion engine 10 is shown constructed in accordance with the present invention. The internal combustion engine 10 generally comprises a cylinder head 12, a cylinder block 14 having a cylinder 16 and a piston 18, an intake rotary valve assembly 66, an exhaust rotary valve assembly 67, and variable restrictors 100.

In a preferred embodiment, the cylinder head 12 comprises a lower cylinder head section 22 and an upper cylinder head section 50. The upper and lower cylinder head sections 22, 50 may have a plurality of openings 38 therethrough to receive a spark plug 40. Fluid cooling ducts may also be formed in the upper and lower cylinder head sections 22, 50 to dissipate heat during engine operation. The upper cylinder head section 50 may be secured to the lower cylinder head section 22 by any conventional means, such as bolts. It is contemplated that the lower and upper cylinder head sections 22, 50 may be any desired shape or configuration.

In a preferred embodiment, the upper cylinder head section 50 includes an upper surface 52 and a lower surface 54. The lower surface 54 of the upper cylinder head section 50 preferably has a plurality of cavities (not shown) to accommodate the rotary valve assemblies 66, 67.

The lower cylinder head section 22 is preferably secured to the cylinder block 14. The lower cylinder head section 22 preferably includes an upper surface 24, a lower surface 26, side walls 28, an intake passage 30, a cylinder intake passage 32, an exhaust passage 34, and a cylinder exhaust passage 36. The upper surface 24 of the lower cylinder head section 22 includes a plurality of intake and exhaust cavities 42, 44 to accommodate the rotary valve assemblies 66.

The intake and exhaust cavities 42, 44 have a first opening 46 and a second opening 48. The first opening 46 of the intake cavity 42 is preferably aligned with and in communication with the intake passage 30 leading to the intake manifold (not shown), while the second opening 48 is preferably in communication with the cylinder intake passage 32 leading to the combustion chamber 20. Similarly, the first opening 46 of the exhaust cavity 44 is preferably aligned with and in communication with the exhaust passage 34 leading to the exhaust manifold (not shown), while the second opening 48 is preferably in communication with the cylinder exhaust passage 36 leading to the combustion chamber 20.

As shown in FIG. 1, the rotary valves assemblies 66, 67 are preferably rotated by a shaft 58. The shaft 58 preferably includes a sprocket 62 that may be rotated by a timing mechanism (not shown), such as a timing chain, timing belt, or other suitable means, so that the rotary valve assemblies 66, 67 maintain a desired relationship with the crank shaft (not shown). A plurality of bearings 64 and spacers 96 may also be secured to the shaft 58. It is contemplated that the engine 10 may only have single valve shaft 58.

In a preferred embodiment, variable restrictor plates 100 may be attached to the sides walls 28 of the cylinder head 12. The variable restrictor plates 100 may control the air flow through the intake passage 30 and exhaust passage 34 to provide high torque throughout the r.p.m. range of the engine 10. Preferably, the variably restrictor plates 100 comprise an intake variable restrictor 102 and a exhaust variable restrictor 104. The intake variable restrictor 102 may be secured between the intake manifold and the cylinder head 12, and the exhaust variable restrictor 104 may be secured between the exhaust manifold and the cylinder head 12.

Figure 2:
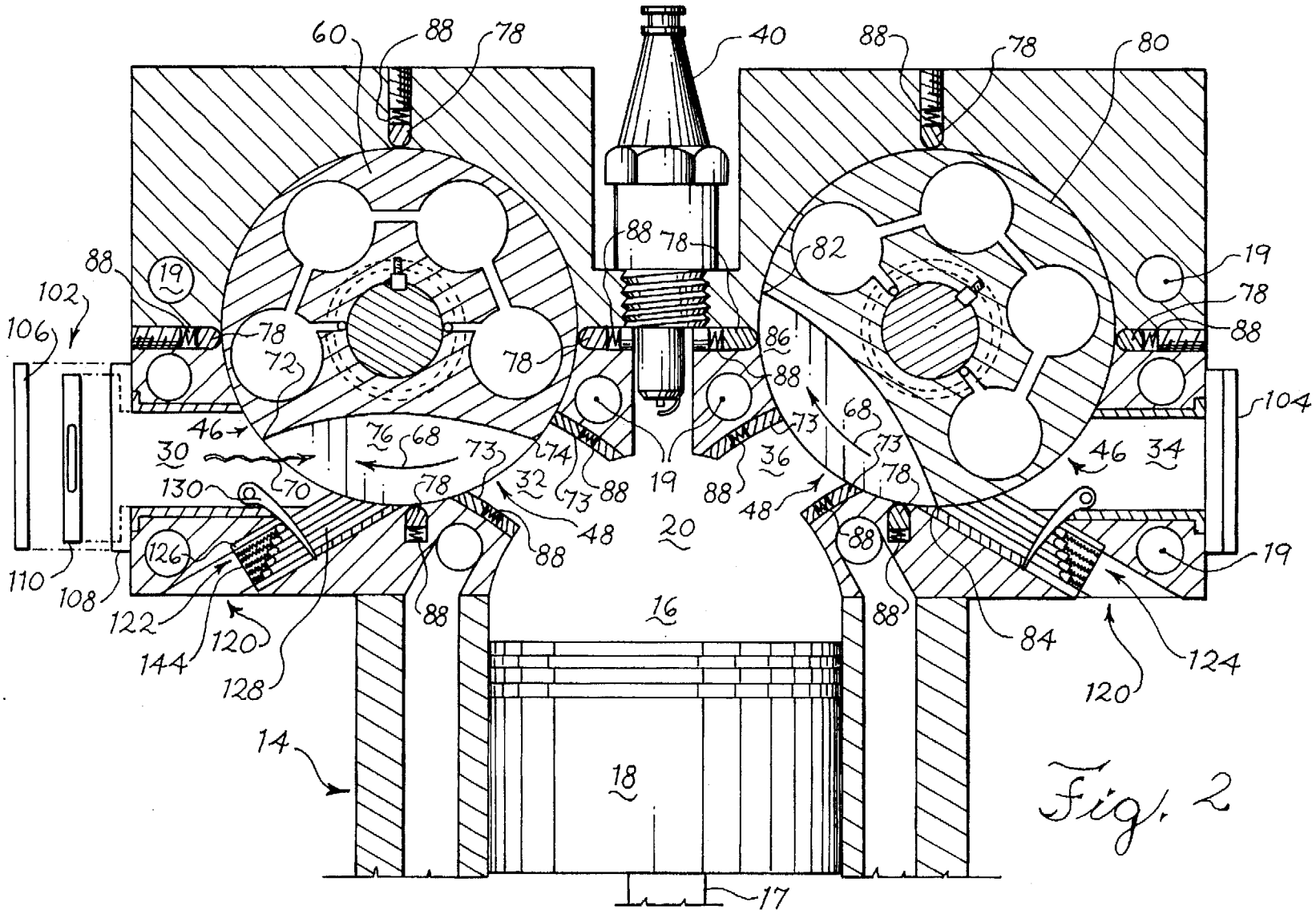
FIG. 2 shows a partial cross-sectional view through a rotary valve assembly of the cylinder head of FIG. 1.

Referring to FIG. 2, the intake variable restrictor 102 may comprise a back plate 108, front plate 106, and inner slide 110. Preferably, the back plate 108 may be secured to the cylinder head 12 by any suitable means, such as bolts or studs, and the front plate 106 may be attached to the back plate 108. The inner slide 110 may be slidably mounted between the front plate 106 and back plate 108. The back plate 108, front plate 106, and inner slide 110 may have openings to correspond with the openings of the intake passage 30. Preferably, the inner slide 110 may be moved to vary or restrict the air flow into the intake passage 30. The inner slide 110 may be moved by any suitable means, such as an electrical motor, vacuum motor, or the like. The inner slide 110 may be moved in response to a vacuum gauge (not shown) disposed in the intake passage 30.

In operation, the intake variable restrictor 102 may vary the air flow through the intake passage at low r.p.m. in order to draw in the air-fuel mixture into the cylinder 16 at a constant rate. Preferably, the vacuum level may be maintained at about 18–20 inches. As the r.p.m. of the engine 10 increases, the intake variable restrictor 102 may be further opened to allow more air to flow into the intake passage 30. Preferably, the intake variable restrictor 102 would be fully opened above 4000 r.p.m., and thus, would not restrict the air flow through the intake passage 30.

In a preferred embodiment, the exhaust variable restrictor 104 may control the flow of the exhaust gases out of the cylinder 16. The exhaust variable restrictor 104 is substantially similar to the intake variable restrictor 102 in construction and operation. Preferably, the exhaust variable restrictor 104 may restrict the flow of the exhaust gases out of the cylinder 16 at low r.p.m. in order to smother the flame in the combustion chamber 20. As a result, the flame may be prevented from entering the intake system and pre-igniting the air-fuel mixture. As the r.p.m. of the engine 10 increases, the exhaust variable restrictor 114 would further open the exhaust passage 34. Preferably, the exhaust variable restrictor 104 would be fully opened above 4000 r.p.m.

Referring again to FIG. 2, a cross-sectional view a rotary valve assembly is shown. A piston 18 is disposed in the cylinder 16 and is attached by a connecting rod 17 to the crankshaft (not shown). The crankshaft is rotatably mounted in the cylinder block 14, and a spark plug 40 is mounted in the cylinder head 12 centrally of the cylinder 16. The spark plug 40 may be fired by any suitable ignition system.

In a preferred embodiment, the rotary valve 60 is for intake and the rotary valve 80 is for exhaust. Preferably, the rotary valves 60, 80 are manufactured from any suitable material, such as stainless steel, alloy steel, plastic, aluminum, or the like. As shown in FIG. 2, arrow 68 shows the direction of rotation of the rotary valves 60, 80 and arrow 70 show the gases entering the combustion chamber 20. It is contemplated that the rotary valves 60, 80 may rotate in either direction depending upon the location of the intake passage 30.

The intake rotary valve 60 may comprise a cylindrical valve body that is rotatably mounted within in the cylinder head 12. The intake rotary valve 60 preferably includes a leading edge 72 and a trailing edge 74 that defines a port or aperture 76 therein. The port 76 allows the intake passage 30 to communicate with the combustion chamber 20. The intake passage 30 preferably extends from the intake manifold to the intake rotary valve 60. The intake manifold preferably communicates with an air-fuel mixture supplying device (not shown), such as a carburetor, fuel injector, or the like.

When the leading edge 72 of the intake rotary valve 60 is in registry with the intake passage 30 as shown in FIG. 2, the air-fuel mixture is allowed to flow from the intake passage 30 to the combustion chamber 20. When the trailing edge 74 of the intake rotary valve 60 assembly rotates out of communication the cylinder intake passage 32, the intake rotary valve 60 is closed and the combustion chamber 20 is sealed from the intake manifold.

In a preferred embodiment, the exhaust rotary valve 80 may comprise a cylindrical valve body that is rotatably mounted within the cylinder head 12. The exhaust rotary valve 80 includes a leading edge 82 and a trailing edge 84 that defines a port or aperture 86 therein. The port 86 allows the combustion chamber 20 to communicate with the exhaust passage 34. The exhaust passage 34 preferably extends from the exhaust rotary valve 80 into an exhaust manifold. The exhaust manifold may communicate with an exhaust system of the associated vehicle.

When the leading edge 82 of the exhaust rotary valve 80 is in registry with the cylinder exhaust passage 36, the exhaust rotary valve 80 is open and the exhaust gases within the combustion chamber 20 may exit from the combustion chamber 20 to the exhaust manifold. When the trailing edge 84 of the exhaust rotary valve 80 rotates out of communication with the exhaust passage 34 as shown in FIG. 2, the exhaust rotary valve 80 is closed and the combustion chamber 20 is sealed from the exhaust manifold.

In a preferred embodiment, a plurality of seals 78 may engage the rotary valves 60, 80. The intake and exhaust passage 32, 36 may have seals 73 to engage the rotary valves 60, 80. The seals 73 and 78 may be made of any suitable material, such as graphite, plastic, porcelain, aluminum, or the like. The seals 73 and 78 may have a resilient member 88, such as a spring, to bias the seals 78 into engagement with the rotary valves 60, 80.

Figure 3:
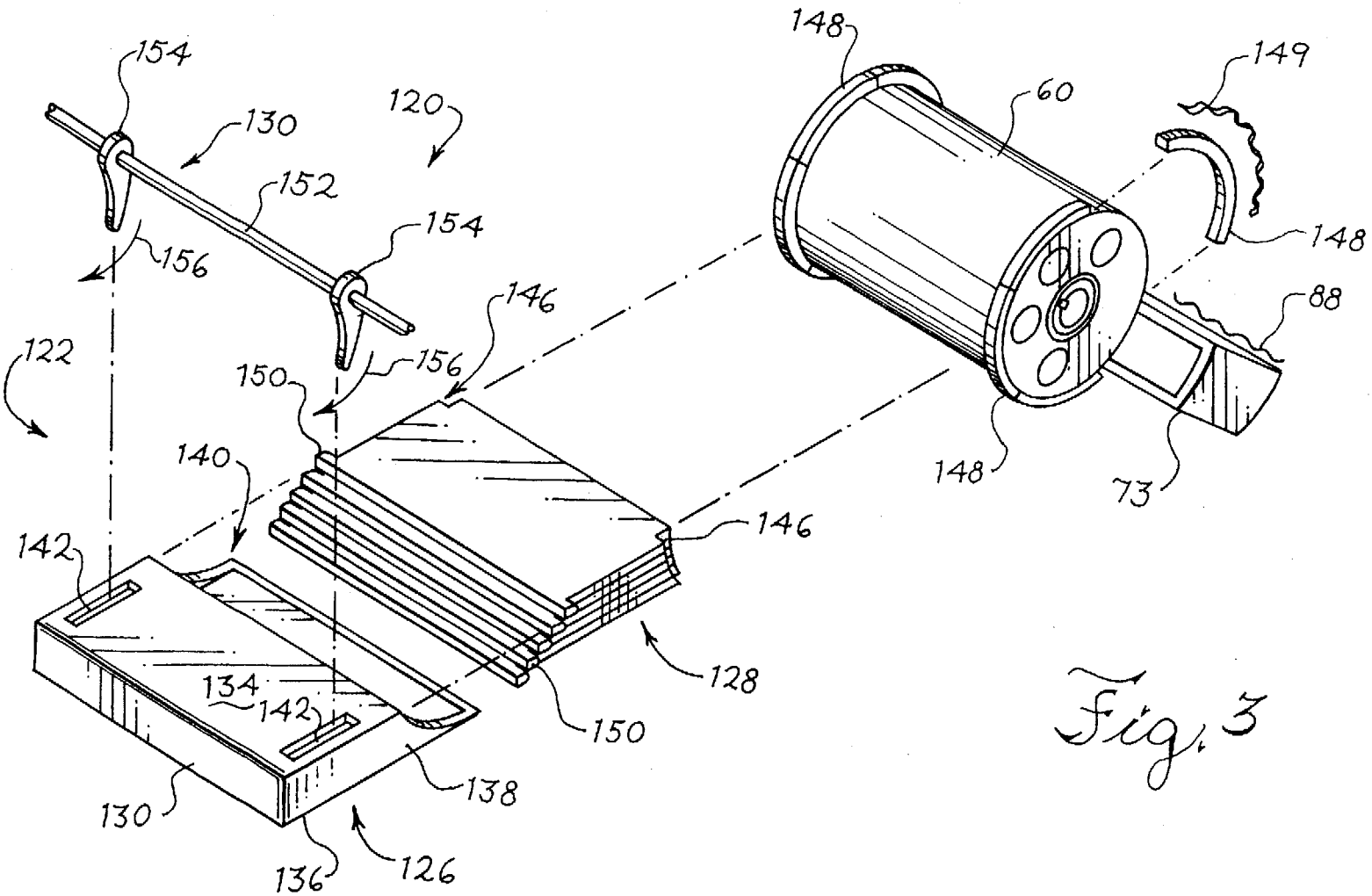
FIG. 3 shows an exploded perspective view of preferred embodiment of the mode changers and rotary valve made in accordance with the present invention for attachment in a cylinder head.

Referring to FIG. 2 and 3, a mode changer or mode adjuster 120 is provided to change or vary the timing and duration of the rotary valves 60, 80 during engine operation. Preferably, the mode changer 120 may vary or change the opening of the intake rotary valve 60 and the closing of the exhaust rotary valve 80. Preferably, the closing of the intake passage 30 and opening of the exhaust passage 34 occur at a predetermined desired time. Preferably, the mode changer 120 comprises an intake mode changer 122 and an exhaust mode changer 124.

The intake mode changer 122 preferably comprises a housing 126, a plurality of plates 128, and an engageable member 130. The housing 126 comprises a bottom 130, an upper surface 134, a lower surface 136, sides 138, and an end 140 adapted to engage the intake rotary valve 60. The upper surface 134 of the housing 126 may have openings 142 adapted to receive the engageable member 130.

In a preferred embodiment, the plates 128 are slidably disposed in the housing 126. Preferably, the plates 128 are made from any suitable material, such as carbon steel, porcelain, plastic, or the like. Preferably, five plates may be slidably movable in the housing. A resilient member 144, such as a spring, may bias the plates 128 against the outer surface of the intake rotary valve 60.

The plates 128 may have an aperture or notch 146 to receive a seal 148. The seal 148 may be bias against the valve by a resilient member 149, such as a spring. The plates 128 may also have a flange or tab 150. The engageable member 130 may engage the tab 150 of the plates 128 to move them towards and away from the intake rotatory valve 60.

The engageable member 130 preferably comprises a rod 152 that extends between a pair of levers 154. The engageable member 130 may be actuated by any suitable means, such as an electric motor, vacuum motor or may be manually controlled, to move or slide the plates 128 into and out of communication with the outer surface of the intake rotary valves. As the engageable member 130 is retracted in the direction indicated by the arrow 156 in FIG. 3, the engageable member 130 may first retract upper most plate, and the next upper most plate, and so forth. The engageable member 130 may then selectively release so that the plates 128 may be biased against the outer surface of the rotary valves. It is contemplated that the engageable member 130 may be positioned on any side of the housing 128, and selectively retract any number of plates 128 depending upon the application of the engine 10. It is also contemplated that the intake mode changer 122 may be replaced by a seal.

In a preferred embodiment, the exhaust mode changer 124 is substantially similar to intake mode changer 122 in construction and operation. The intake and exhaust mode changers 122, 124 may be adjusted to enable the rotary valves to comprise many different modes i.e., different valve timings and durations. For instance, as the plates 128 are moved away from the rotary valves 60, 80, the duration of the exhaust/intake overlap of the rotary valves may increase. The purpose of the overlap is to purge the cylinder 16 in order to clean the exhaust gases out of the cylinder 16. A turbo or super charger may be used to help purge the cylinder 16. It is contemplated that the exhaust mode changer 124 may be replaced by a seal.

In a preferred embodiment, the mode changers 122, 124 may allow the rotary valves 60, 80 to operate in many different modes. Preferably, the mode changers 122, 124 may be adjusted to correspond to the timing of various types of cam shafts used in poppet valve cylinder heads. For example, the timing of the rotary valves 60, 80 may be set at a mild cam of poppet valve engine where the exhaust valve will close, and then the intake valve will open 4° to 6° later (Mode 1). The timing of the rotary valves 60, 80 may also be set at stock cam of a popper valve engine where the closing of the exhaust valve and the opening of the intake valve will occur at about the same time (Mode 2). Further, the timing of the rotary valves 60, 80 may be set at quarter-race (Mode 3), half-race (Mode 4), three-quarter race (Mode 5), and full-race (Mode 6) of a popper type valve engine by varying the intake and exhaust mode changers 122, 124. The different modes of the valves allow the horsepower of the engine 10 to be increased and decreased as desired. The modes of the valves may be adjusted to reduce emissions and reduce fuel consumption, such as in Mode 1.

To implement the different modes, the opening of the intake rotary valve 60, and the closing of the exhaust rotary valve 80 may be varied. Preferably, the opening of the intake rotary valve 60 and the closing of the exhaust rotary valve 80 may occur at various location or points along the outer surface of the rotary valve 60, 80. Preferably, these locations correspond to various degrees located about the rotary valves 60, 80.

Figure 2A:
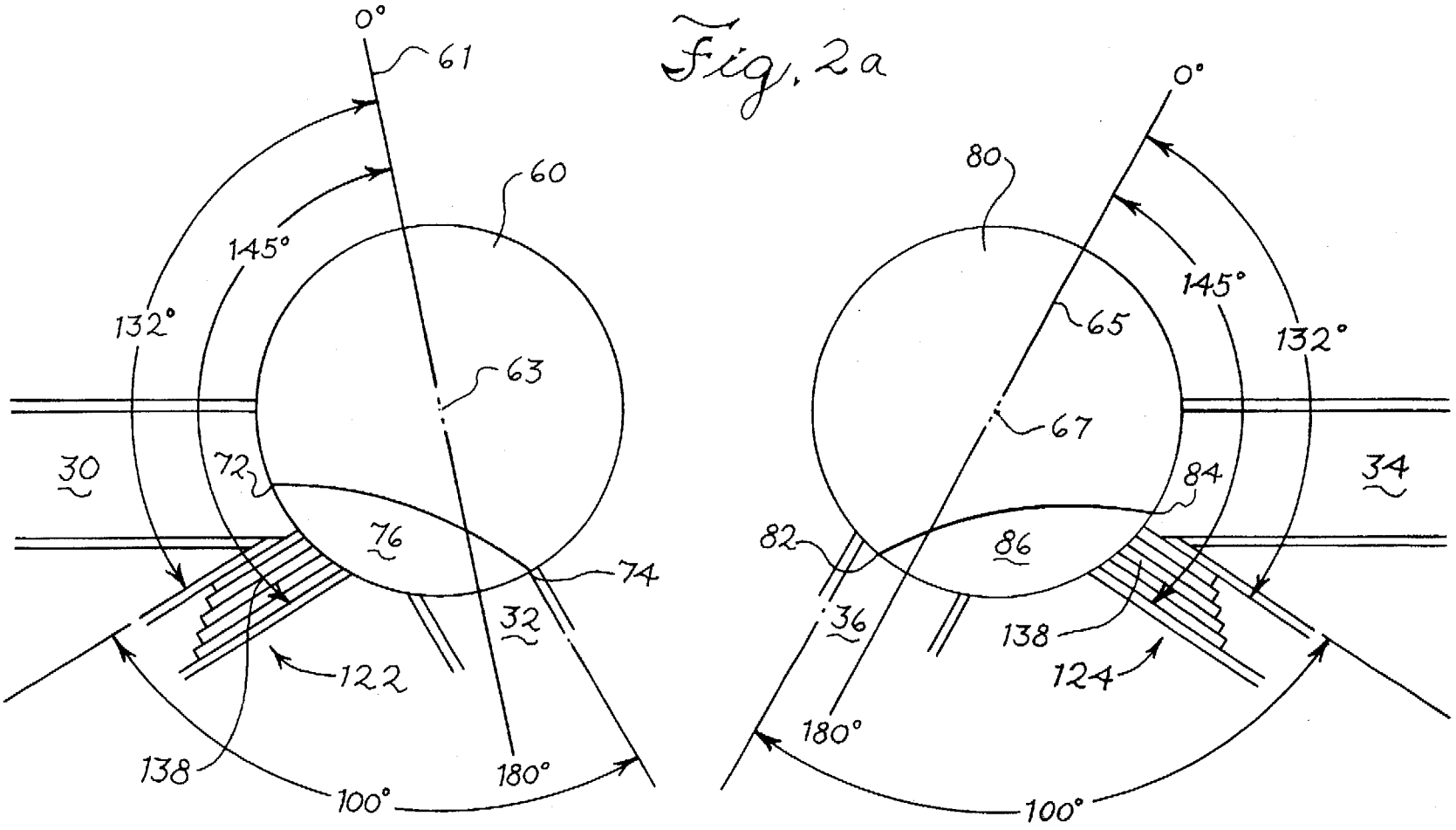
FIG. 2*a* shows a diagrammatical view of the location in degrees of the mode changers of the cylinder head of FIG. 2.

As shown in FIG. 2*a*, a centerline 61 is drawn through the center 63 of the intake rotary valve 60 and through the middle of the cylinder intake passage 32. The middle of the cylinder intake passage 32 is preferably at about 180°. The opening of the intake rotary valve 60 may occur between about 115° to 155°. Preferably, the opening of the intake rotary valve 60 may occur between about 132° to 145°. Each plate 138 of the intake mode changer 122 may vary the opening of the intake rotary valve 60 about 3° to 8°.

Similarly, the closing of the exhaust rotary valve 80 may occur at various degrees about the exhaust rotary valve 80 depending upon the desired mode. As shown in FIG. 2*a*, a centerline 65 is drawn through the center 67 of the exhaust rotary valve 80 and through the middle of the cylinder exhaust passage 36. The middle of the cylinder exhaust passage 36 is preferably at 180°. The closing of the exhaust rotary valve 80 may occur at about 115° to 155°. Preferably, the closing of the exhaust rotary valve occurs at about 132° to 145°. Each plate 128 of the exhaust mode changer 124 may vary the closing of the exhaust rotary valve 80 from about 3° to 8°.

Figure 4:
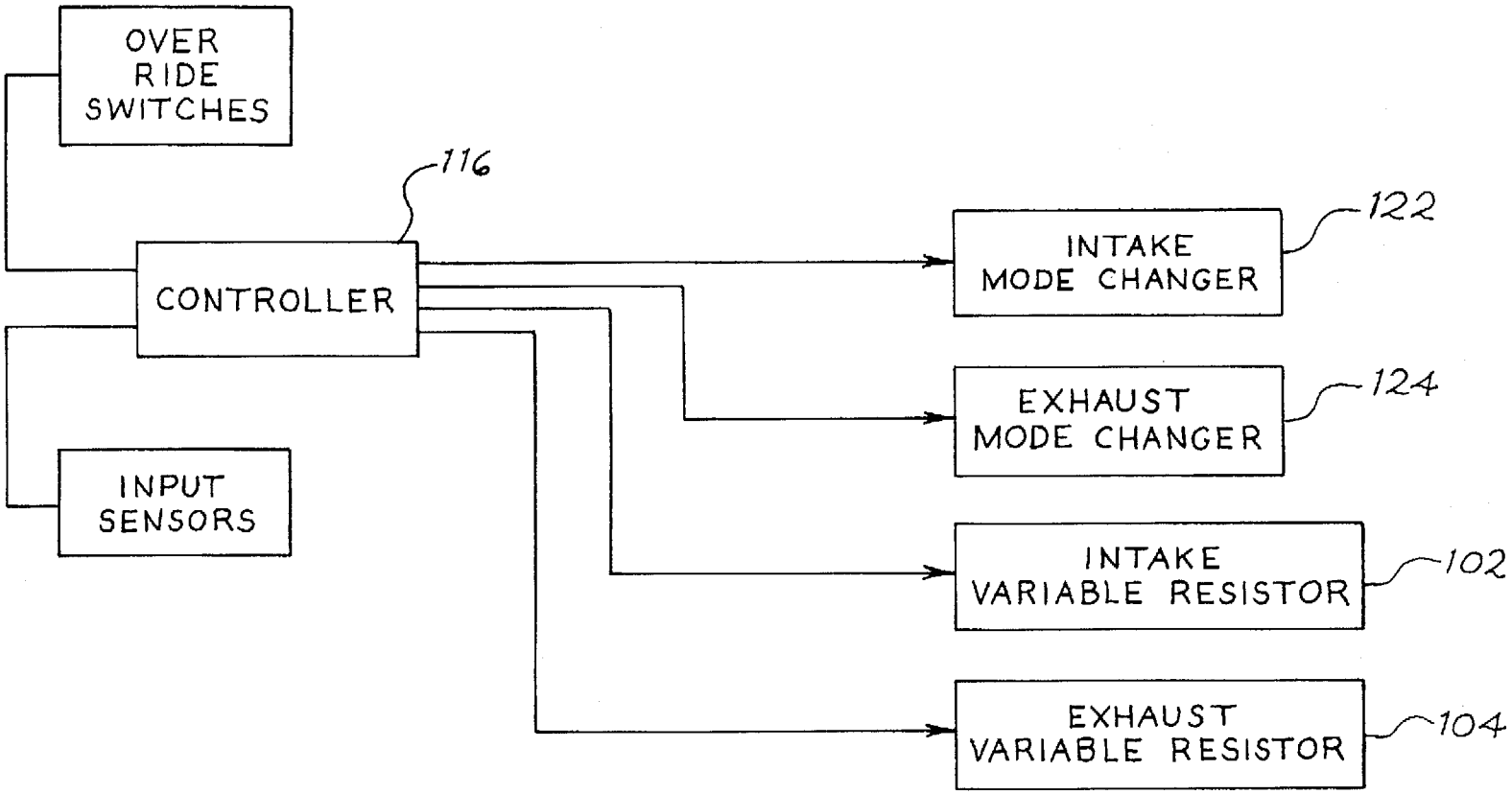
FIG. 4 shows a diagrammatical view diagram of a preferred embodiment of a controller made in accordance with the present invention.

Referring to FIG. 4, the timing and duration of the engine 10 may be changed while the engine 10 is running. Preferably, the intake and exhaust mode changer 122, 124, and the intake and exhaust variable restrictors 102, 104 may be in communication with a control mechanism 116. The control mechanism 116 may communicate with each of the mode changers 122, 124 and the variable restrictors 102, 104 by any suitable means, such as an electric motor and vacuum motor, or may be manually controlled. The control mechanism 116 may comprise a computer or any manual operated device. Preferably, the control mechanism 116 may control the desired setting of the mode changers 122, 124 and the variable restrictors 102, 104 and may be programmed to automatically change the modes of the valves. The control mechanism 116 may change the modes of the engine in response to a command from a driver and may have buttons or switches to allow a driver to manually switch the modes.

The operation of the engine 10 will now be described in reference to FIG. 2*a*. As shown in FIG. 2*a*, the intake rotary valve 60 is at the point of initially opening with the leading edge 72 of its port 76 just out of alignment with the edge of the intake mode changer 122. The intake mode changer 122 may be varied so that the leading edge 72 of the intake rotary valve 60 may be advanced or retarded. As discussed above, the plates 128 of the intake mode changer 122 may be moved away from the intake rotary valve 60 to allow air to enter the combustion chamber 20 at an earlier time, thereby advance the timing of the intake valve.

As the port 76 of the intake rotary valve 60 is rotated across the intake passage 30, the piston 18 moves downwardly drawing a fuel/air mixture into the cylinder 16 for combustion. When the piston 18 has reached about its lowermost position within the cylinder 16, the intake passage 30 of the cylinder 16 will close. At this point, the trailing edge 74 of the intake rotary valve 60 would have moved out of communication with the cylinder intake passage 32, thus sealing the intake passage 30 from the combustion chamber 20.

When the intake passage 30 and exhaust passage 34 are sealed, the piston 18 will rise compressing the fuel/air mixture. When the piston 18 nears the top of the cylinder 16, the spark plug 40 will fire and the piston 18 will be driven downwardly within the cylinder 16. Then, the piston 18 will commence an upward stroke for the evacuation of the exhaust gases. At about this point, the leading edge 82 of the exhaust rotary valve 80 will be in registry with the edge of the cylinder exhaust passage 36. As the port 86 of the exhaust valve rotates 80 along the cylinder exhaust passage 36, the exhaust passage 34 may be in communication with the combustion chamber 20 and the exhaust gases may be exhausted.

Upon completion of the evacuation of the exhaust gases, the port 86 of the exhaust rotary valve 80 will move out of communication with the exhaust passage 34, and the exhaust passage 34 will be closed from the combustion chamber 20. At this point, the trailing edge 84 of the exhaust rotary valve 80 will be registry with the edge of the exhaust mode changer 124. The exhaust mode changer 124 may be varied so that the trailing edge 84 of the exhaust rotary valve 80 may be advanced or retarded. As discussed above, the plates 128 may be moved away from the exhaust rotary valve 80 to allow the exhaust rotary valve 80 to close at a later time, retarding the timing of the exhaust rotary valve 80.

Subsequently, the port 76 of the intake rotary valve 60 may move into communication with the intake passage 30 for the reintroduction of the fuel/air mixture.

Figure 5:
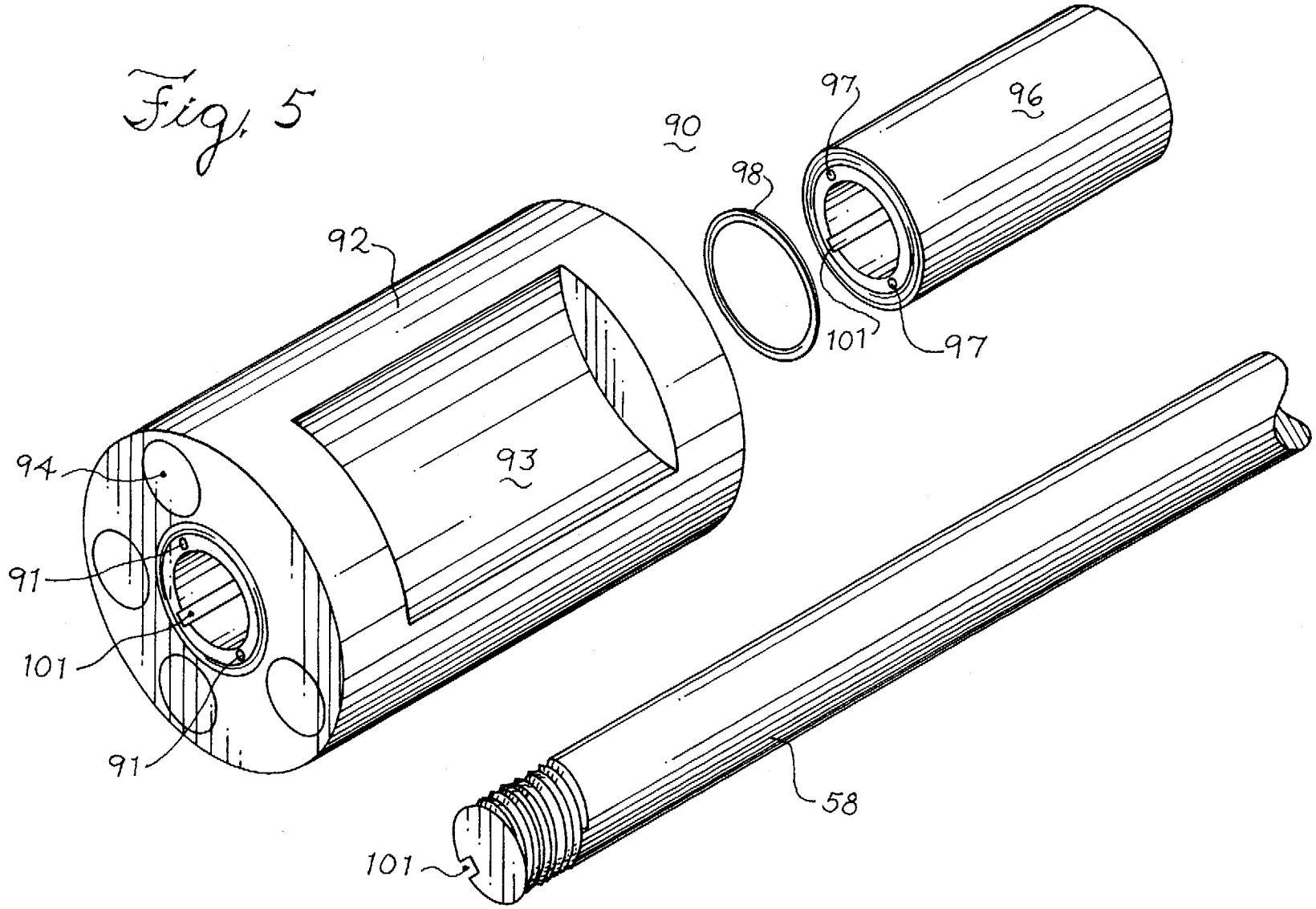
FIG. 5 is an fragmentary exploded perspective view of a preferred embodiment of a rotary valve made in accordance with the present invention.

Referring to FIG. 5, a preferred embodiment of a rotary valve assembly 90 is illustrated for attachment to the shaft 58 of the engine 10. The rotary valve assembly 90 preferably comprises a rotary valve 92, a spacer 96, and a seal 98. Preferably, the rotary valve 92 comprises a port 93 and a cavity 94. The cavity 94 includes a plurality of chambers extending axially therein, and plugs (not shown) may be used to seal the chambers. The cavity 94 may receive a fluid, such as oil, in ordered to cool the rotary valve 92. After the fluid absorbs the heat, the fluid may flow out of the cavity 94. The fluid may be pumped into the cavity 94 in any suitable manner. Preferably, the fluid may enter the cavity 94 at an opening 91 near the center of the rotary valve 92.

The spacer 96 may have an opening 97 to allow the fluid to flow therethrough and to an adjacent rotary valve. The spacer 96, shaft 58, and rotary valve 92 may be keyed 101 for proper alignment, and the seal 98 may be positioned between the spacer 96 and the rotary valve 92. The seal 98 may be made out of any suitable material, such as teflon. The oil cooled valve helps decrease emissions and extend the life of the valve.

Although the present invention has been described in detail by way of illustration and example, it should be understood that a wide range of changes and modifications can be made to the preferred embodiment described above without departing in any way from the scope and spirit of the invention. For example, although the preferred embodiment shows a four stroke engine, the rotary valve system of the present invention may be employed in almost any type of internal combustion engine, including stratified charge engines, engines operating on a two stroke cycle and diesel engines, or any other type of engine having intake and exhaust valves. Additionally, the internal combustion engine 10 may comprise any number of cylinders. Thus, the described embodiment is to be considered in all respects only as illustrative and not restrictive, and the scope of the invention is, therefore, indicated by the appended claims rather than the foregoing description. All changes that come within the meaning and range of equivalency of the claims are to be embraced within their scope.

I claim:

1. A mode changer for a rotary valved internal combustion engine comprising:

a housing;

a body member disposed within the housing, the body member adapted to communicate with an outer surface of a rotary valve, the body member comprising a plurality of plates;

a resilient member disposed in the housing capable of biasing the body member against the outer surface of the rotary valve; and an engageable member to selectively move the body member.

2. The mode changer of claim 1 wherein the body member comprises five plates.

3. The mode changer of claim 1 wherein the resilient member comprises a spring.

4. The mode changer of claim 1 wherein the engageable member comprises a lever.

5. The mode changer of claim 4 further comprising a pair of levers and a rod extending between the levers.

6. An engine apparatus for an internal combustion engine comprising:

at least one rotary valve for opening and closing an intake passage and for opening and closing exhaust passage, the at least one rotary valve having an outer surface;

a mode changer adapted to contact the outer surface of the rotary valve, the mode changer having a first position wherein the mode changer engages a portion of the outer surface of the at least one rotary valve and a second portion wherein the mode changer is disposed at a predetermined distance away from the outer surface of the at least one rotary valve.

7. The apparatus of claim 6 wherein the mode changer comprises a plurality of plates.

8. The apparatus of claim 6 wherein the mode changer comprises an intake mode changer, the intake mode changer changing the opening of the rotary valve.

9. The apparatus of claim 6 wherein the mode changer comprises an exhaust mode changer, the exhaust mode changer capable of changing the closing of the rotary valve.

10. The apparatus of claim 6 further comprising a controller in communication with the mode changer.

11. The apparatus of claim 6 further comprising a variable restrictor to regulate air flow through the intake passage.

12. The apparatus of claim 11 further comprising a controller in communication with the variable restrictor.

13. the apparatus of claim 6 further comprising a variable restrictor configured to regulate air flow in the exhaust passage.

14. The device of claim 6 wherein the mode changer is configured to open at least one valve between about 115° and 155° from a centerline extending through the center of at least one rotary valve and through the middle of a cylinder passage. passage.

15. An engine apparatus of an internal combustion engine comprising:

a first rotary valve adapted to open and close an intake passage;

a first mode changer having at least one plate, the at least one plate reciprocably disposed with the outer surface of the first rotary valve to contact a portion of the outer surface in a first position and to be at a predetermined distance away from the outer surface in a second position; and a second rotary valve adapted to open and close an exhaust passage;

a second mode changer having at least one plate adapted to contact the outer surface of the second rotary valve in a first position and to be at a predetermined distance away from the outer surface in a second position.

16. The apparatus of claim 15 wherein the first mode changer comprises a plurality of plates.

17. The apparatus of claim 15 wherein the second mode changer comprises a plurality of plates.

18. The apparatus of claim 15 further comprising a controller in communication with one of the first mode changer and the second mode changer.

19. The apparatus of claim 15 further comprising a variable restrictor to regulate air flow into the internal combustion engine.

20. The apparatus of claim 19 further comprising a controller in communication with the variable restrictor.

21. The apparatus of claim 19 wherein the variable restrictor comprises one of an intake variable restrictor and an exhaust variable restrictor.

22. The apparatus of claim 15 wherein the first rotary valve includes a cavity capable of holding a fluid.

23. The apparatus of claim 15 wherein the second rotary valve includes a cavity capable of holding a fluid.

24. The apparatus of claim 15 wherein at least one of the first rotary valve and second rotary valve includes a leading edge and a trailing edge defining an indentation therebetween.

25. The apparatus of claim 15 wherein the first mode changer is configured to open the first rotary valve between about 115 degrees and 155 degrees from a centerline extending through the center of the first rotary valve and through the middle of a cylinder passage.

26. The apparatus of claim 15 wherein the second mode changer is configured to close the second rotary valve between about 115 degrees and 155 degrees from a centerline extending through the center of the second rotary valve and through the middle of a cylinder passage.

* * * * *